US006520066B2

(12) United States Patent
Skirde et al.

(10) Patent No.: US 6,520,066 B2
(45) Date of Patent: Feb. 18, 2003

(54) ADJUSTING MEANS FOR AN AXIAL PISTON MACHINE OF INCLINED-AXIS CONSTRUCTION

(75) Inventors: Eckhard Skirde, Aukrug-Böken (DE); Vladimir Galba, Nova' Dubnica (SK)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 09/948,734

(22) Filed: Sep. 7, 2001

(65) Prior Publication Data

US 2002/0066364 A1 Jun. 6, 2002

(30) Foreign Application Priority Data

Sep. 11, 2000 (DE) ..... 100 44 784

(51) Int. Cl.[7] ..... F01B 13/04
(52) U.S. Cl. ..... 92/12.2; 91/504
(58) Field of Search ..... 92/12.2; 91/504, 91/505, 506

(56) References Cited

U.S. PATENT DOCUMENTS 2,008,937 A * 7/1935 Thoma ..... 91/505
4,253,381 A * 3/1981 Wartelle ..... 91/506
4,893,549 A * 1/1990 Forster ..... 91/506

FOREIGN PATENT DOCUMENTS

| | | | | |
|---|---|---|---|---|
| DE | 1 453 493 | * | 1/1969 | 91/504 |
| DE | 1 528 473 | * | 8/1969 | 91/504 |
| DE | 1 923 451 | * | 11/1970 | 91/504 |
| DE | 26 12 270 | * | 9/1977 | 91/506 |
| DE | 3625429 A | * | 2/1988 | 91/504 |
| FR | 1152134 | * | 2/1958 | 91/506 |

* cited by examiner

*Primary Examiner*—Edward K. Look
*Assistant Examiner*—Thomas E. Lazo

(57) ABSTRACT

An inclined-axis variable displacement unit comprises an output shaft (1), mounted in a housing (4), and a cylinder block (10), the cylinder block (10) being connected to the output shaft (1) via a synchronizing articulation (18), and via working pistons (11) which can be displaced in the cylinder block (10), the cylinder block (10) being mounted in a pivoting body (5) which can be pivoted in relation to the axis of the output shaft (1) by an adjusting means, it being the case that the adjusting means is arranged on that side of the pivoting body (5) on which the output shaft is located.

10 Claims, 6 Drawing Sheets

ADJUSTING MEANS FOR AN AXIAL PISTON MACHINE OF INCLINED-AXIS CONSTRUCTION

FIELD OF THE INVENTION

The invention relates to an inclined-axis variable displacement unit or an axial piston machine.

The generally known operating principle of such machines is based on an oil-volume stream being converted into a rotary movement.

BACKGROUND OF THE INVENTION

The prior art discloses axial piston machines in which the cylinder block can be pivoted in relation to the axis of the output shaft. In these axial piston machines, the adjusting means is arranged on that side of the cylinder block which is located opposite the drive shaft, and it has a double-acting servocylinder with servovalve. This design has the disadvantage of a long overall length and of the maximum pivoting angle of the cylinder block in relation to the output shaft being small as a result of the design.

Patent DE-A-198 33 711 discloses an axial piston machine of the above construction in which a lever mechanism is additionally provided in order to increase the maximum pivoting angle of the cylinder block in relation to the output shaft. This design, however, results in a further increase in the overall length. A further disadvantageous effect may be that the hysteresis of the control characteristics is increased as a result of possible play in the lever mechanism.

The object of the present invention is to provide an inclined-axis variable displacement unit or an axial piston machine of inclined-axis construction in which the above mentioned disadvantages are eliminated or minimized, in particular in which a small overall length of the machine is achieved along with, at the same time, an increased maximum pivoting angle.

SUMMARY OF THE INVENTION

Arranging the adjusting means on that side of the pivoting body on which the output shaft is located achieves an extremely compact construction. The elements for controlling and for limiting the rotation of the pivoting body are located in the interior of a housing, and it is not necessary to provide any installation spaces in addition to those in the prior art. The reduction in the overall size likewise makes possible a lower weight of the axial piston machine according to the invention. The configuration of the servovalve brings about a reduction in the control hysteresis. Finally, the transmission of vibrations and noise to the surroundings is minimized.

DESCRIPTION OF THE PREFERRED EMBODIMENT

Figure 1:
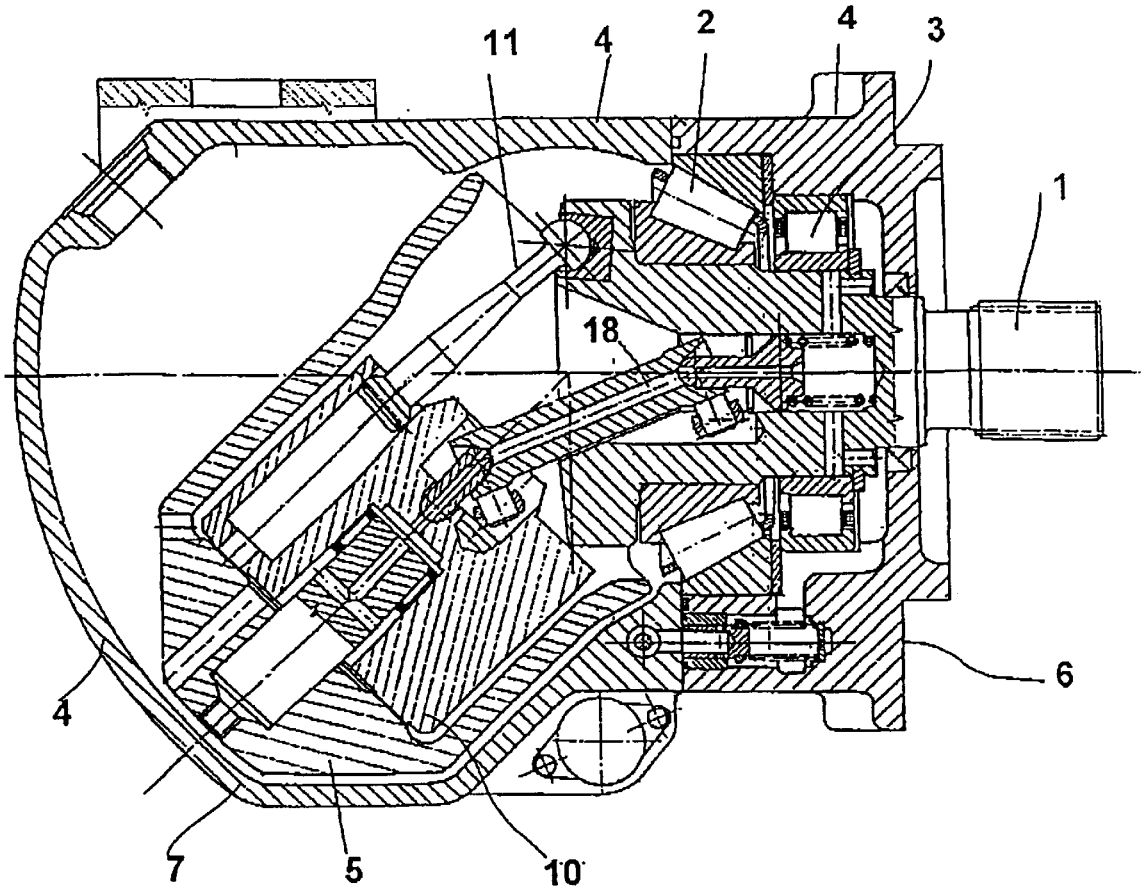
FIG. 1 shows a cross section of an inclined-axis variable displacement unit according to the invention in the plane defined by the axis of the output shaft and the axis of the cylinder block.

FIG. 1 illustrates a housing 4 of the unit, within which a pivoting body 5 is mounted. Located within said pivoting body 5, in turn, is a cylinder block 10, which is mounted axially. The cylinder block 10 is connected to an output shaft 1 via a synchronizing articulation 18. The output shaft 1 is mounted in the housing 4 by a first rolling-contact bearing 2 and a second rolling-contact bearing 3. The housing comprises a bearing housing part 6 and a housing cover 7.

It can also be seen in this view that working pistons 11, which are connected to the output shaft 1, are mounted displaceably in a cylinder opening of the cylinder block 10.

The pivoting body 5 is inclined by a pivoting angle β in relation to the axis of the output shaft 1. In this illustration, this angle β=45°.

Figure 2:
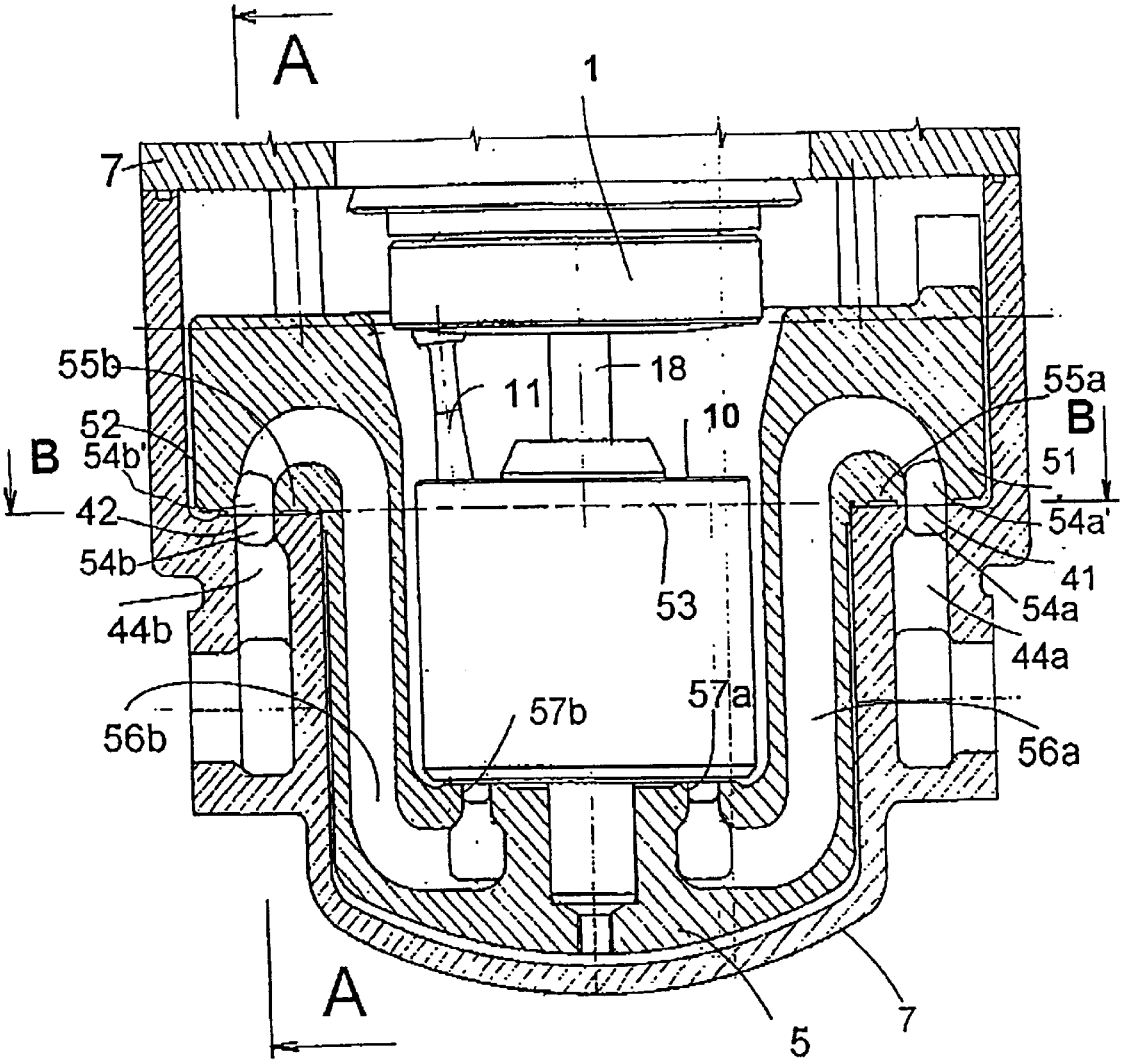
FIG. 2 shows a cross section of the inclined-axis variable displacement unit according to the invention in a plane defined by the center axis of the cylinder block, this being perpendicular to the drawing plane, according to FIG. 1.

As can be seen in FIG. 2, the pivoting body 5 is subdivided into two symmetrical cylinder segments 51 and 52. These cylinder segments 51 and 52 form an imaginary cylindrical plane 53 which intersects the space in which the working pistons 11 and the cylinder block 10 are mounted.

It can be seen that non-stationary transfer channels 56*a* and 56*b* are arranged in the respective cylinder segments, the respective top ends of said transfer channels opening out into throughflow chambers 54*a*' and 54*b*'. These throughflow chambers 54*a*' and 54*b*' overlap with throughflow chambers 54*a* and 54*b* in the housing 4, which, in turn, are connected to stationary transfer channels 44*a* and 44*b*. The operating fluid is supplied and discharged via these channels 44*a* and 44*b*.

The plane of the hydrostatic slide mounting for the pivoting body 5, which coincides with the imaginary cylinder plane 53, is thus located in the region of said throughflow chambers 54*a*, 54*b*, 54*a*' and 54*b*'.

Figure 3:
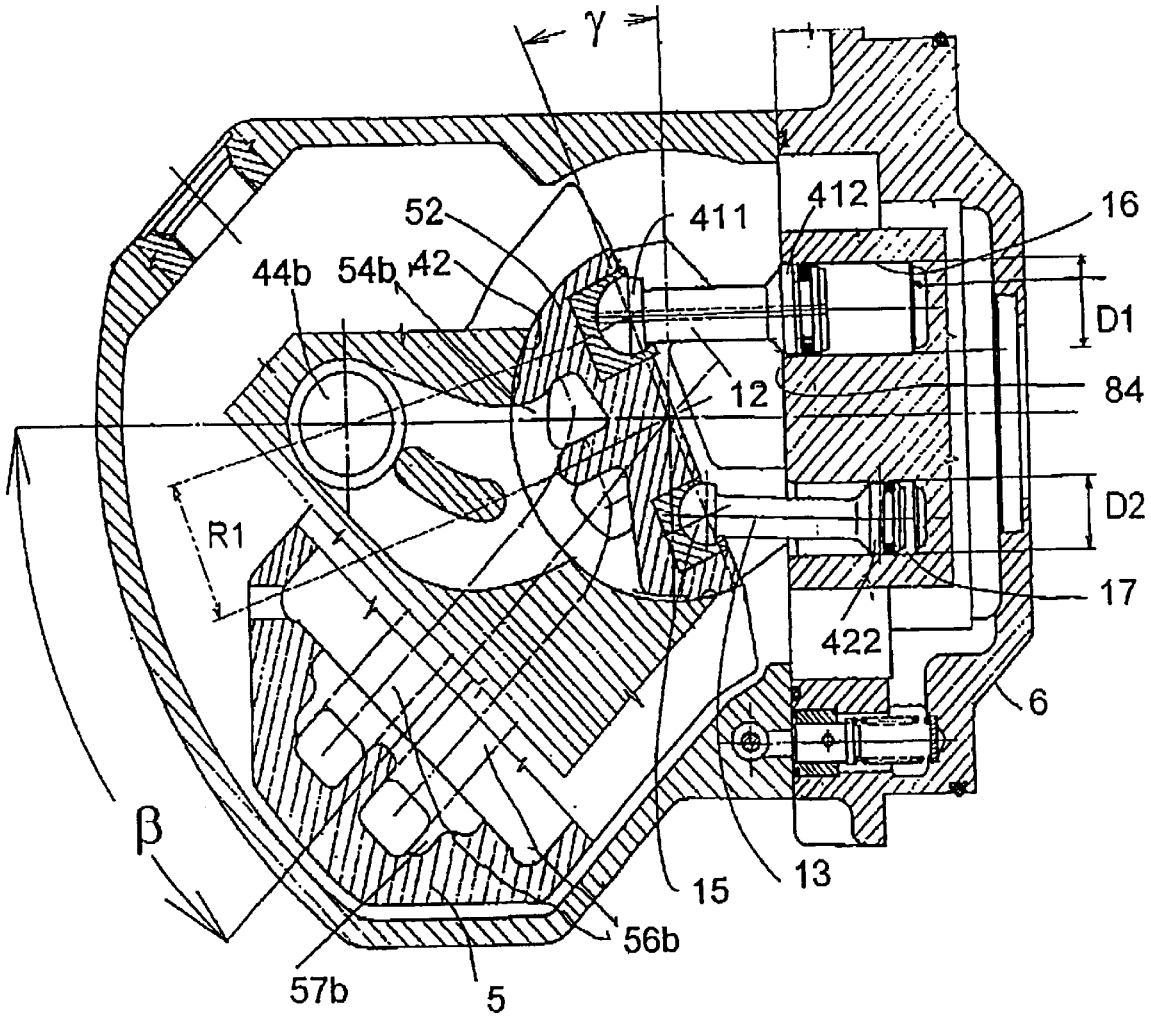
FIG. 3 shows a section along line A—A according to FIG. 2.

FIG. 3 shows a section along line A—A according to FIG. 2, i.e., a section through the left-hand cylinder segment 52 and the corresponding portion of the housing 4. The latter has the stationary transfer channel 44*b*, which then opens out into the throughflow chamber 54*b*. The circle-segment channel 57*b* is arranged in the base of the pivoting body 5. In the exemplary embodiment shown here, the non-stationary transfer channel 56*b*, which connects the segment channel 57*b* to the throughflow chamber 54*b*, is configured by two parallel channels.

The cylinder segment 52 is mounted for hydrostatic sliding action in the concave hollow 42, which is located in the housing cover 7, while the opposite end is connected to the bearing housing part 6 via an axially displaceable first and second control piston 12 and 13. The control pistons 12 and 13 here are guided in an axially displaceable manner on the side of the bearing housing part 6, in a first control cylinder 16 and a second control cylinder 17 and, on the side of the cylinder segment 52, connected to the latter with the aid of articulation connections 14 and 15. As a result, the cylinder segment can rotate in the concave hollow 42 by the first control piston being displaced in the opposite direction to the second control piston.

As can be seen from FIG. 3, the connecting line which runs through the centres of the articulation connections 14 and 15 encloses an angle γ with a plane located perpendicularly to the axis of the shaft 1. The control cylinders 16, 17 cause the pivoting body 5, to which the cylinder segment 52 is connected, to rotate. The angles β and γ are basically design parameters, the optimum design being β=2γ. In the present exemplary embodiment, the axis of the cylinder block 10 thus encloses an angle β in relation to the axis of the shaft 1, said angle β being double the size of the above described angle γ (β=kγ, where k=2). The smaller amount of rotation of the pivoting body 5 with the cylinder segment 52 achieves an optimum throughflow cross section over the largest pivoting angle range for feeding the oil to the working cylinder. This, in turn, results in a lower flow speed in the throughflow channels, a lower flow resistance and, ultimately, in higher efficiency of the axial piston machine.

A value of k=2 is particularly advantageous. However, it is also possible, within the scope of the invention, to select other factors, e.g. k=1.0 to k=5.

Figure 4:
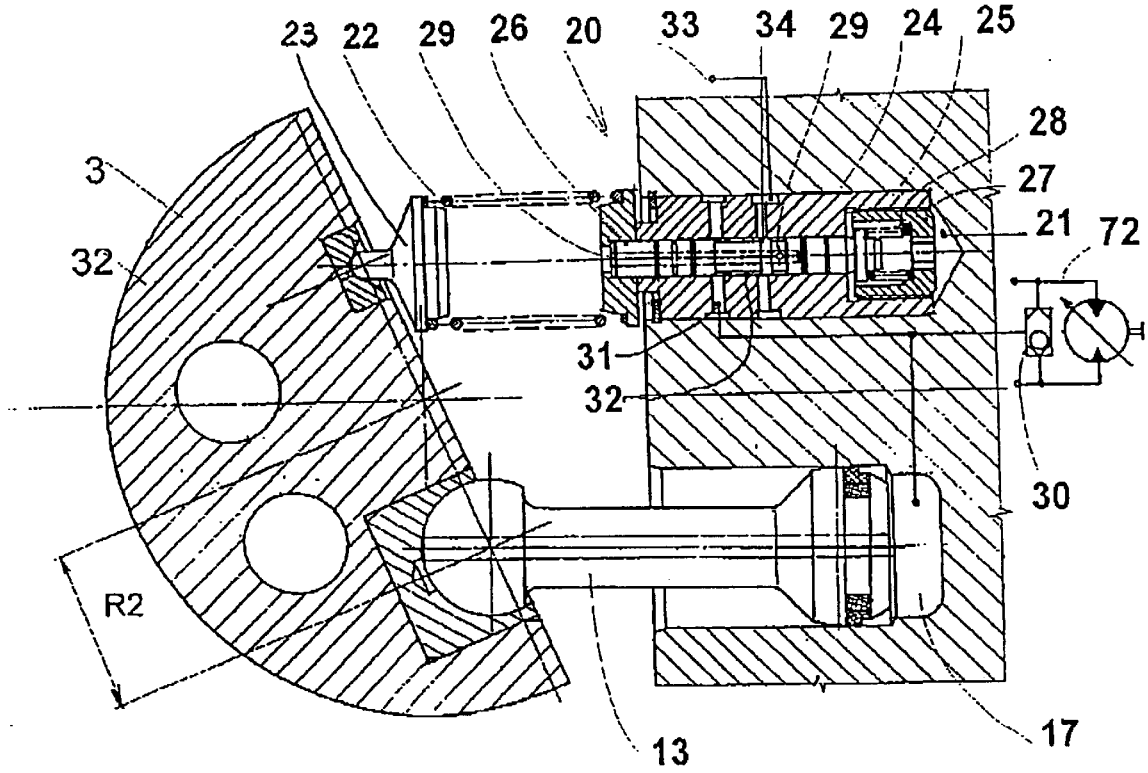
FIG. 4 shows a cross section through the servovalve and the second control cylinder.

FIG. 4 shows part of the hydraulic circuit for controlling the angle γ and thus also the angle β via the control pistons 12 and 13. A srvovalve 20, arranged in the bearing housing part 6, is connected to a control channel 21. Depending on the magnitude of the pressure in the control channel 21, the cylinder segment is adjusted into the corresponding rotary position. The feedback to the servovalve 20 here takes place by the feedback spring 22, which on the side of the cylinder segment 52, is connected in an articulated manner to the cylinder segment 52 via a first spring mount 23.

The servovalve 20 has a distributor 24 which comprises a sleeve 25 and a slide 26. The sleeve 25 is fixed in a bore in the bearing housing part 6 by a securing ring. The slide 26 is mounted in an axially displaceable manner in the sleeve 25. Located at the control-channel end of the sleeve 25 is an actuating member 27, which is connected to the slide 26 via a control channel spring 28. Depending on the pressure in the control channel and depending on the rotary position of the cylinder segment 52, the slide 26 is subjected to forces on both sides via the feedback spring 22 and the control channel spring 28, with the result that the slide 26 is displaced axially in accordance with the state of equilibrium.

The second control cylinder 17 is connected permanently to a high-pressure branch of the axial piston machine via a double check valve 30, with the result that the second control cylinder 17 subjects the cylinder segment 52 to a constant force via the second control piston 13.

The servovalve 20 is likewise connected to a high-pressure branch of the axial piston machine via the double check valve 30. The servovalve 20 itself is connected, in turn, to the first control cylinder 16. As long as the servovalve releases the connection between the high-pressure branch and the first control cylinder 16, the cylinder segment 52 in FIG. 4 moves in the opposite, clockwise direction, since the torque to which the cylinder segment 52 is subjected by the first control piston 12 is greater than the counter-torque produced by the second control piston 13. This is achieved, in the case of a circular cross section of the control cylinders, by the product $R1 \times D1^2$ being greater than the product $R2 \times D2^2$ where D1 and D2 are the diameters of the first and second control cylinders and R1 and R2 are the distances between the articulation connections 14 and 15 and the central point of rotation of the cylinder segment 52 (see FIGS. 3 and 4). The torque resulting from $R2 \times D2^2$ multiplied by the high pressure is in equilibrium with the torque resulting from $R1 \times D1^2$ multiplied by the regulating pressure, the regulating pressure being smaller than the high pressure and being adjusted via the throughflow resistance of the servovalve 20.

In the case of such rotation of the pivoting body 5 with the cylinder segment 52 in the opposite, clockwise direction, the hydraulic oil flows from the line 31 in the sleeve 25 via an annular space 32, which is located between the sleeve 25 and the slide 26, and via the line 33 to the first control cylinder 16. The corresponding position of the slide 26 is shown in FIG. 4.

Once the desired rotary position of the pivoting body 5 with the cylinder segment 52 has been reached, the servovalve 20 closes the connection between the first control cylinder 16 and the high-pressure branch since the slide 26 has been displaced in the direction of the cylinder segment 52 to such an extent that the control edge 34 of the slide 26 closes the line 33 to the first control cylinder.

If the pressure in the control channel 21 increases, then the slide 26 is forced in the direction of the cylinder segment 52, that is to say to the left in FIG. 4. A resulting displacement of the control edge 34 connects the line 33 to the channel 29, which runs first of all radially, and then axially, in the region of the line 33 in the slide 26. The oil located in the first control cylinder 16 is thus emptied into the housing interior via the line 33 and the channel 29.

If the desired rotary position of the cylinder segment 52 has been reached, the servovalve 20 closes the connection between the first control cylinder 16 and the housing interior since the slide 26 has been displaced away from the cylinder segment 52 to such an extent that the control edge 34 of the slide 26 closes the line 33 to the first control cylinder.

In the case of large changes in the control pressure in the control channel 21, the maximum rotational speed of the cylinder segment 52 is limited in a desired manner since the flow speed of the hydraulic oil is reduced by the small throughflow cross sections in the servovalve 20.

Figure 5:
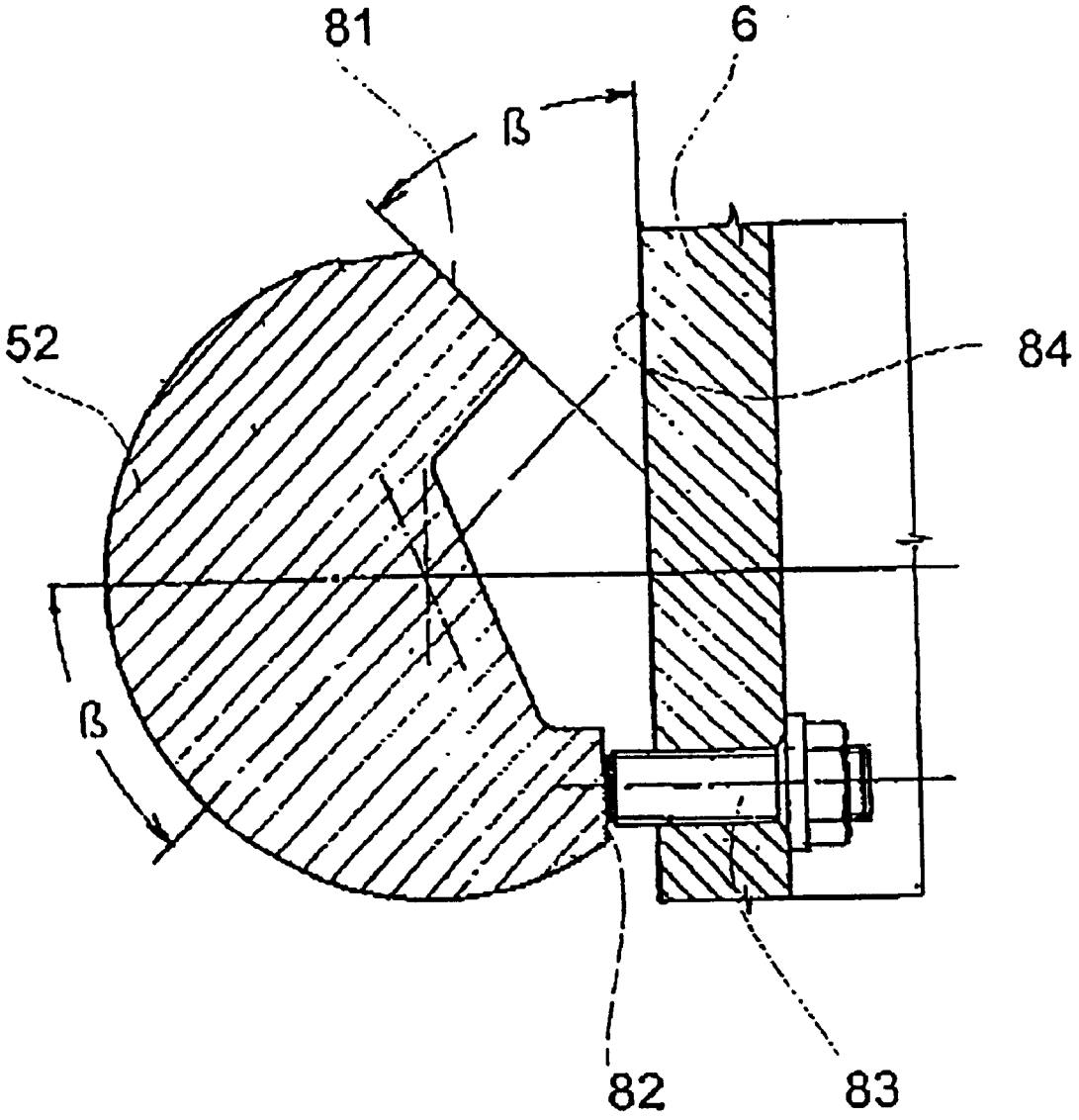
FIG. 5 shows a cross section through the stop means of the adjusting means.

The stop surfaces of the adjusting means can be seen in FIGS. 5 and 3. The stop surface 84 is integrally formed on the bearing housing part and butts against the stop surface 81 of the cylinder segment 52 at an angle of β=0. The maximum rotation of the cylinder segment is limited by the stop surface 82 of the cylinder segment and the adjusting screw 83 arranged in the housing part 6. The transmission of vibrations and noise to the surroundings is reduced to a considerable extent by this configuration.

The special configuration of the inclined-axis variable displacement unit according to the invention can advantageously be used in particular in closed hydraulic circuits and with the geometrical working volume changing within wide limits, with a pivoting angle of up to β=45°, for example in inclined-axis variable displacement motors. A further advantageous use is in pumps which do not require any movement reversal in the throughflow, as is the case, for example, in pumps for open hydraulic circuits.

Figure 6:
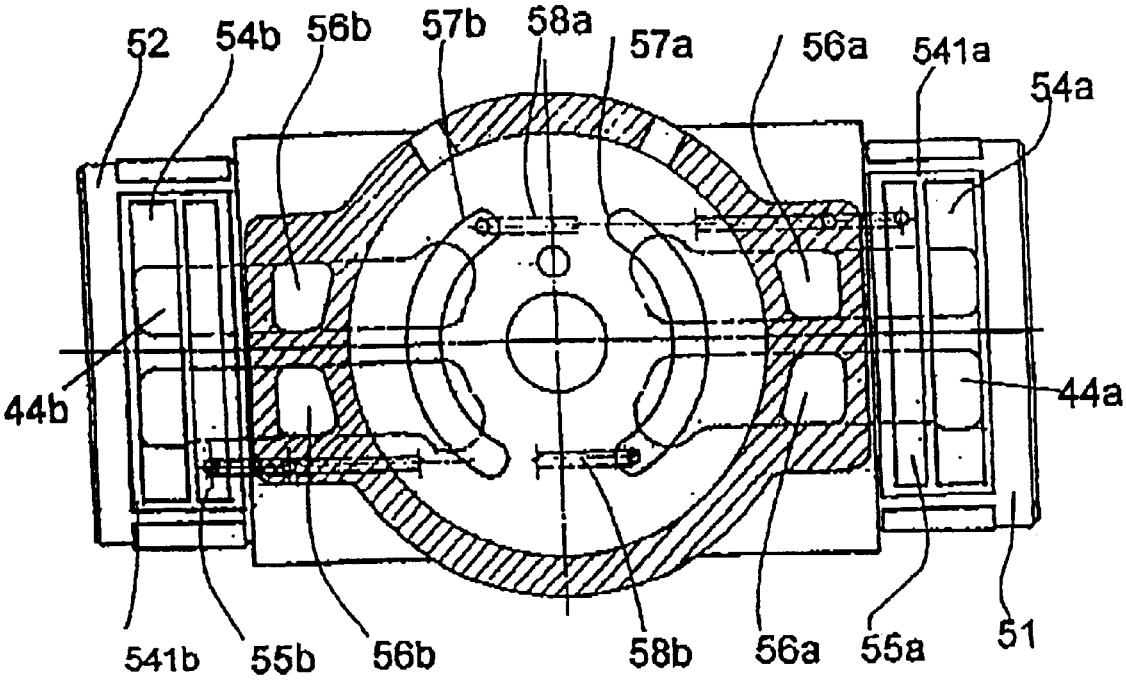
FIG. 6 shows a section along line B—B according to FIG. 2.

FIG. 6 represents a sectional illustration along B—B according to FIG. 2, i.e. along the cylinder plane 53. In this view, it is possible to see the corresponding openings of the non-stationary transfer channels 56*a* and 56*b*, the openings of the stationary transfer channels 44*a* and 44*b* and the throughflow chambers 54*a* and 54*b*. These throughflow chambers 54*a* and 54*b* extend, transversely to the openings of the respective transfer channels, over more or less the entire length of the cylinder segments 51 and 52. In order to compensate as advantageously as possible for the forces acting on the pivoting body 5, the cylinder segments 51 and 52 are provided with corresponding compensation chambers 55*a* and 55*b*, The compensation chambers 55*a* and 55*b*, like the throughflow chambers 54*a* and 54*b*, are enclosed by corresponding sealing zones 541*a* and 541*b*. According to the invention, the compensation chamber 55*a* is connected to the circle-segment channel 57*b* via a connecting channel 58*a*, while the compensation chamber 55*b* is connected to the circle-segment channel 57*a* via a corresponding connecting channel 58*b*.

The pressure signal is then fed to said compensation chambers 55*a* and 55*b*, via the connecting channels 58*a* and 58*b*, from the non-stationary transfer channels 56*b* and 56*a* on the opposite side of the pivoting body 5.

Since the diameter of the cylinder segments 51 and 52 in the configuration according to the present invention is considerably smaller than the respective configurations from the prior art, the length of that stretch which each point of the cylindrical plane 53 has to cover during adjustment of the pivoting body 5 is also shorter. It is thus always possible to provide a sufficient throughflow width for the throughflow chambers 54*a* and 54*b*. At the same time, it is possible to mount the pivoting body 5 in the stationary part of the housing 4 in the vicinity of the separating plane 45 of the housing 4. In this way, the vibrations of the housing which occur on account of the cyclic loading of the pivoting body 5, can be reduced to a considerable extent. As can be seen in FIG. 2, the end side 21 of the rolling-contact bearing 2 is thus located in the separating plane 45 of the housing 4.

It is therefore seen that this invention will achieve at least all of its stated objectives.

List of Designations

1 Output shaft
2 First rolling-contact bearing
3 Second rolling-contact bearing
4 Housing
5 Pivoting body
6 Base of the pivoting body
10 Cylinder block
11 Working piston
12 First control piston
13 Second control piston
14 Articulation connection
15 Articulation connection
16 First control cylinder
17 Second control cylinder
18 Synchronizing articulation
20 Servovalve
21 Control channel
22 Feedback spring
23 Spring mount
24 Distributor
25 Sleeve
26 Slide
27 Actuating member
28 Control-channel spring
29 Channel
30 Double check valve
31 Line
32 Annular space
33 Line
34 Control edge
41, 42 Hollows
44*a*, 44*b* Stationary transfer channels
45 Separating plane of the housing
51, 52 Cylinder segments
53 Imaginary cylinder plane
54*a*, 54*b* Throughflow chambers in the housing
54*a*', 54*b*' Throughflow chambers in the pivoting body
55*a*, 55*b* Compensation chambers
56*a*, 56*b* Non-stationary transfer channels
57*a*, 57*b* Circle-segment channels
58*a*, 58*b* Connecting channels
81 Stop surface
82 Stop surface
83 Adjusting screw
84 Stop surface
541*a*, 541*b* Sealing zones
β Pivoting angle of the cylinder segment
γ Pivoting angle of the cylinder block

We claim:

1. An inclined-axis variable displacement unit comprising an output shaft (1), mounted in a housing (4), and a cylinder block (10), the cylinder block (10) being connected to the output shaft (1) via a synchronizing articulation (18), and via working pistons (11) which can be displaced in the cylinder block (10), the cylinder block (10) being mounted in a pivoting body (5) which can be pivoted in relation to the axis of the output shaft (1) by an adjusting means, characterized in that the adjusting means is arranged on that side of the pivoting body (5) on which the output shaft is located;

wherein the adjusting means comprises at least one pair of control pistons (12, 13), in each case the first control piston (12) being guided displaceably in a first control cylinder (16) and the respectively second control piston (13) being guided displaceably in a second control cylinder (17), the first control piston (12) being displaced in the opposite direction to the second control piston (13) during a rotation of the pivoting body (5); and wherein the pivoting body ends of the first and of the second control piston (12, 13) are connected to a cylinder segment (52) via first and second articulation connections (14, 15), said cylinder segment, in turn, being connected to the pivoting body (5).

2. The inclined-axis variable displacement unit according to claim 1, characterized in that the cylinder black (10) is rotated to a more pronounced extend than the cylinder segment (52) with respect to the shaft (1), with the result that a rotation (Δβ) of the cylinder block (10) in relation to a rotation (Δγ) of the cylinder segment (52) has a value (k) which is greater than or equal to 1.0.

3. The inclined-axis variable displacement unit according to claim 2, characterized in that the rotation (Δβ) of the cylinder block (10) in relation to the rotation (Δγ) of the cylinder segment (52) has a value (k) of from 1.2 to 5.

4. The inclined-axis variable displacement unit according to claim 2, characterized in that the rotation (Δβ) of the cylinder block (10) in relation to the rotation (Δγ) of the cylinder segment (52) has a value (k) of 2.

5. An inclined-axis variable displacement unit comprising an output shaft (1), mounted in a housing (4), and a cylinder block (10), the cylinder block (10) being connected to the output shaft (1) via a synchronizing articulation (18), and via working pistons (11) which can be displaced in the cylinder block (10), the cylinder block (10) being mounted in a pivoting body (5) which can be pivoted in relation to the axis of the output shaft (1) by an adjusting means, characterized in that the adjusting means is arranged on that side of the pivoting body (5) on which the output shaft is located, wherein the adjusting means comprises a servovalve (20).

6. The inclined-axis variable displacement unit according to claim 5, characterized in that the rotation of the cylinder block (10) is controlled via the pressure conditions in a control channel (21) which is connected to the servovalve (20).

7. The inclined-axis variable displacement unit according to claim 6, characterized in that the servovalve (20) has a distributor (24) which comprises a sleeve (25) and a slide (26), one end being connected to the control channel (21) via a channel spring (28) and an actuating member (27) and the other end being connected to the cylinder segment (52) via a feedback spring (22) and a spring mount (23).

8. The inclined-axis variable displacement unit according to claim 7, characterized in that a line (33) which leads to the first control cylinder (16), in dependence on the position of the slide (26), is connected either to the high-pressure line of the inclined-axis variable displacement unit or, via a channel (29) within the slide (26), to the interior of the housing or else is closed by a control edge (34) of the slide (26).

9. An inclined-axis variable displacement unit comprising an output shaft (1), mounted in a housing (4), and a cylinder block (10), the cylinder block (10) being connected to the output shaft (1) via a synchronizing articulation (18), and via working pistons (11) which can be displaced in the cylinder block (10), the cylinder block (10) being mounted in a pivoting body (5) which can be pivoted in relation to the axis of the output shaft (1) by an adjusting means, characterized in that the adjusting means is arranged on that side of the pivoting body (5) on which the output shaft is located, wherein the product $D1^2 \times R1$) of the square of the diameter (D1) of the first control cylinder (16) and the distance (R1) between the first articulation connection (14) and the central point of rotation of the cylinder segment (52) is greater than the product ($D2^2 \times R2$) of the square of the diameter (D2) of the second control cylinder (17) and a distance (R2) between the second articulation connection (15) and the central point of rotation of the cylinder segment (52).

10. An inclined-axis variable displacement unit comprising an output shaft (1), mounted in a housing (4), and a cylinder block (10), the cylinder block (10) being connected to the output shaft (1) via a synchronizing articulation (18), and via working pistons (11) which can be displaced in the cylinder block (10), the cylinder block (10) being mounted in a pivoting body (5) which can be pivoted in relation to the axis of the output shaft (1) by an adjusting means, characterized in that the adjusting means is arranged on that side of the pivoting body (5) on which the output shaft is located, wherein the second control cylinder (17) is connected permanently to the high-pressure line of the inclined-axis variable displacement unit.

* * * * *